US007553133B2

(12) United States Patent
Rousset

(10) Patent No.: US 7,553,133 B2
(45) **Date of Patent: *Jun. 30, 2009**

(54) CIRCUMFERENTIAL PISTON COMPRESSOR/PUMP/ENGINE (CPC/CPP/CPE); CIRCUMFERENTIAL PISTON MACHINES

(76) Inventor: Patrick Wade Rousset, 603 French St., New Orleans, LA (US) 70124

( * ) Notice: Subject to any disclaimer, the term of this patent is extended or adjusted under 35 U.S.C. 154(b) by 189 days.

This patent is subject to a terminal disclaimer.

(21) Appl. No.: 11/379,085

(22) Filed: Apr. 18, 2006

(65) Prior Publication Data

US 2006/0245938 A1 Nov. 2, 2006

Related U.S. Application Data

(63) Continuation of application No. 10/424,671, filed on Apr. 28, 2003, now Pat. No. 7,029,241.

(60) Provisional application No. 60/375,889, filed on Apr. 26, 2002.

(51) Int. Cl.
*F04B 27/08* (2006.01)

(52) U.S. Cl. ..... 417/269; 418/195

(58) Field of Classification Search ..... 91/500, 91/499; 123/43 A; 417/269, 265, 523, 462, 417/271, 545; 418/195
See application file for complete search history.

(56) References Cited

U.S. PATENT DOCUMENTS

| | | | | |
|---|---|---|---|---|
| 32,372 | A * | 5/1861 | Jones et al. | 418/195 |
| 739,207 | A * | 9/1903 | Nielsen | 418/195 |
| 1,392,390 | A | 10/1921 | Anderson | |
| 2,016,605 | A | 10/1935 | Kempthome | |
| 2,561,808 | A | 7/1951 | McCombie | |
| 2,691,348 | A | 10/1954 | Gunther | |
| 3,075,506 | A | 1/1963 | Berry | |
| 3,101,700 | A | 8/1963 | Bowdish | |
| 3,795,179 | A * | 3/1974 | Picker | 91/500 |
| 3,809,025 | A | 5/1974 | Harper | |
| 3,945,766 | A | 3/1976 | Gelon | |
| 4,024,841 | A | 5/1977 | Smith | |
| 4,166,438 | A | 9/1979 | Gottschalk | |
| 4,277,228 | A | 7/1981 | Dantlgraber | |
| 4,540,343 | A | 9/1985 | Perkins | |
| 4,858,480 | A | 8/1989 | Rohde et al. | |
| 5,249,506 | A | 10/1993 | Willimczik | |
| 5,249,512 | A | 10/1993 | Christenson | |
| 5,636,561 | A | 6/1997 | Pecorari | |
| 5,647,729 | A | 7/1997 | de Jong et al. | |
| 5,960,697 | A | 10/1999 | Hayase et al. | |
| 6,352,418 | B1 | 3/2002 | Kohsokabe et al. | |
| 6,368,072 | B1 | 4/2002 | Inoue et al. | |

(Continued)

FOREIGN PATENT DOCUMENTS

| | | |
|---|---|---|
| JP | 02305381 | 12/1990 |

*Primary Examiner*—Devon C Kramer
*Assistant Examiner*—Todd D Jacobs
(74) *Attorney, Agent, or Firm*—Garvey, Smith, Nehrbass & North, L.L.C.; Seth M. Nehrbass; Charles C. Garvey, Jr.

(57) ABSTRACT

A rotary piston machine includes a first spheroidal element including pistons and/or cylinders and a second spheroidal element including pistons and/or cylinders, wherein the first element can move relative to the second element. The machine can be used as part of a pump, compressor, or engine.

18 Claims, 13 Drawing Sheets

U.S. PATENT DOCUMENTS 6,663,354 B2 12/2003 Forster
6,874,994 B2 4/2005 Folsom et al.
7,029,241 B2 * 4/2006 Rousset ..... 417/269
2001/0014288 A1 8/2001 Lynn et al.

* cited by examiner

CIRCUMFERENTIAL PISTON COMPRESSOR/PUMP/ENGINE (CPC/CPP/CPE); CIRCUMFERENTIAL PISTON MACHINES

CROSS-REFERENCE TO RELATED APPLICATIONS

This is a continuation of my U.S. patent application Ser. No. 10/424,671, filed 28 Apr. 2003 now U.S. Pat. No. 7,029, 241 and published as US2004/0022645 on 5 Feb. 2004. Priority of my U.S. Provisional Patent Application No. 60/375, 889, filed 26 Apr. 2002, incorporated herein by reference, is hereby claimed. Incorporated herein by reference are the two above-referenced patent applications, my international patent application no. PCT/US2003/12948, filed 28 Apr. 2003, and published as international publication no. WO 03/091571, and all publications mentioned herein.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to compressors, pumps, and engines. More particularly, the present invention relates to a pumping apparatus that includes two housing or rotor sections that engage a spherical bearing that enables each housing section to rotate together but about different axes of rotation. These axes intersect to form an obtuse angle. Valved pistons on the housing sections pump fluid as the housing sections are rotated.

2. General Background of the Invention

The three predominate forms of pumping, driving and compressing that are available on the market at the time of this document are reciprocating, mechanical screw and rotary and centrifugal.

The following patent documents are incorporated herein by reference:

U.S. Pat. Nos. 3,945,766; 4,277,228; 4,858,480; 5,249, 512; 5,647,729; 6,352,418; 6,368,072; JP 02305381A and US2001/0014288.

U.S. Published Patent Application No. US2001/0014288 discloses a pump with a back and forth piston motion (see FIG. 12).

BRIEF SUMMARY OF THE INVENTION

The present invention provides a unique pump apparatus. However, the mechanism of the present invention can also be configured to be a compressor or engine. As used herein, the term pump should be broadly construed to include any piston machine including but not limited to a pump, a compressor or engine.

The apparatus includes a first housing or rotor section having a concave portion. A second housing section is provided that also has a concave portion.

A spherically shaped bearing member forms an interface between the first and second housing sections so that the concave portion of each of the housing sections fits and conforms to the outer surface of the spherically shaped bearing member. The outer surface of the spherical bearing member and the inner surface of the concave portions are preferably identically curved.

A first shaft is provided for rotating the first housing section about a first axis. A second shaft can be provided for rotating with the second housing section about a second axis that forms an obtuse angle with the first axis.

A plurality of valved pistons are positioned circumferentially about the spherically bearing member, each piston having an upper portion on the first housing section and a second portion on the second housing section.

A means is provided for rotating one of the shafts to initiate the pumping apparatus. The rotating means can be, for example, a motor, engine or the like.

The pistons are interconnected so that they interconnect the first and second housing sections. When one housing section is rotated, the other housing section rotates with it. As a shaft (e.g., powered or driven) is rotated, its housing sections rotate about different axes that form an obtuse angle. Because of this obtuse angle seen in FIGS. 5-10, the periphery of one housing section approaches and then spaces away from the periphery of the other housing section in continuous fashion along a circumferential path.

A fluid flow path transmits fluid though the housing sections using the pistons. Each piston reciprocates to pump fluid under pressure as the housing sections rotate.

The first and second housing sections can each have a generally rounded periphery. At least one of the concave sections of the housing sections, and preferably both of the concave sections of the housing sections, closely conform to and fit the outside surface of the spherically shaped bearing member. The pistons can be equally spaced apart, positioned radially of and circumferentially around the spherically shaped bearing member.

The pistons preferably each include interlocking portions of the first and second housing sections.

Each piston can include a projecting part of one of the housing sections and a socket part of the other of the housing sections. The projecting and socket parts interlock. Each piston is valved (e.g., two check valves) so that as each piston expands and contracts, fluid is pumped through the piston in a desired direction.

The machine (e.g., pump, compressor, engine) of the present invention was invented to replace the three predominate forms of pumping, driving and compressing that are available on the market at the time of this document.

The machine of the present invention combines the good attributes of each and discards the inadequacies. Inherently, a reciprocating device is very flexible in its variations of flow stream acceptability while having many moving parts subject to wear and damage.

This machine of the present invention has the ability to fit a wide variety of flow situations by varying speed and loading and unloading individual piston/receiver pairs. This flexibility is accomplished with very few moving parts subject to wear and damage.

Mechanical screw rotary devices have few moving parts yet they cannot accept high speeds due to the geometry and shear mass of the rotating compression screws. They also require extensive sealing be it mechanical or oil flood to entrap the compression fluids. Screw type compressors fit the function of compressing fluids from a set pressure to a higher pressure at a set flow rate and can do little with varying flow conditions.

The machine of the present invention institutes the small number of wear parts inherent to the screw while surpassing its ability to be flexible. Centrifugal devices have the ability to compress large quantities of fluids from low pressure to high pressure yet they accept little variations in flow rate and pressure differential. So much is the effect of variations, in a driver configuration (turbine) intricate surge control systems must be designed to protect the units against damage. In addition, very little solid particular or larger matter introduced to the flow stream will produce catastrophic and costly damage. Centrifugal devices are not positive displacement and are greatly affected by stream contents and characteristics.

The machine of the present invention has the ability to compress large quantities of fluids with increased speeds or staging of the unit while not being affected adversely by the content nor characteristics of the flow stream being positive displacement and not dependant on the holding of tight engaging dimensions.

Using, for example, the stream requirements of typical offshore facilities and for a summary, three types of compression are used. For vapor (low-pressure) compression, rotary oil flood screws are used to compress fluid up to low-pressure well pressures. This stream is combined with low-pressure wells and introduced to a reciprocating compressor to bring the stream first to the pressure of intermediate fluid then to deliver the fluid to a turbine driven centrifugal compressor for boosting to pipeline pressure at large flow rates.

This machine of the present invention replaces all three units at the facility in a multi-stage configuration. The multi-stage unit would be setup in stage series and parallel configurations per stage if required as follows: Stage 1 is vapor compression, stage 2 is low-pressure fluid, stage 3 is intermediate pressure fluid, stage four high-pressure boost.

All compression is accommodated in one multi-stage unit with less vulnerability to wear and failure and with the flexibility required. To enhance the appeal of the machine of the present invention, an engine can be used to integrally drive a multi-stage unit for an extreme savings of labor, repair, deck space platform weight and operator interface.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1A:
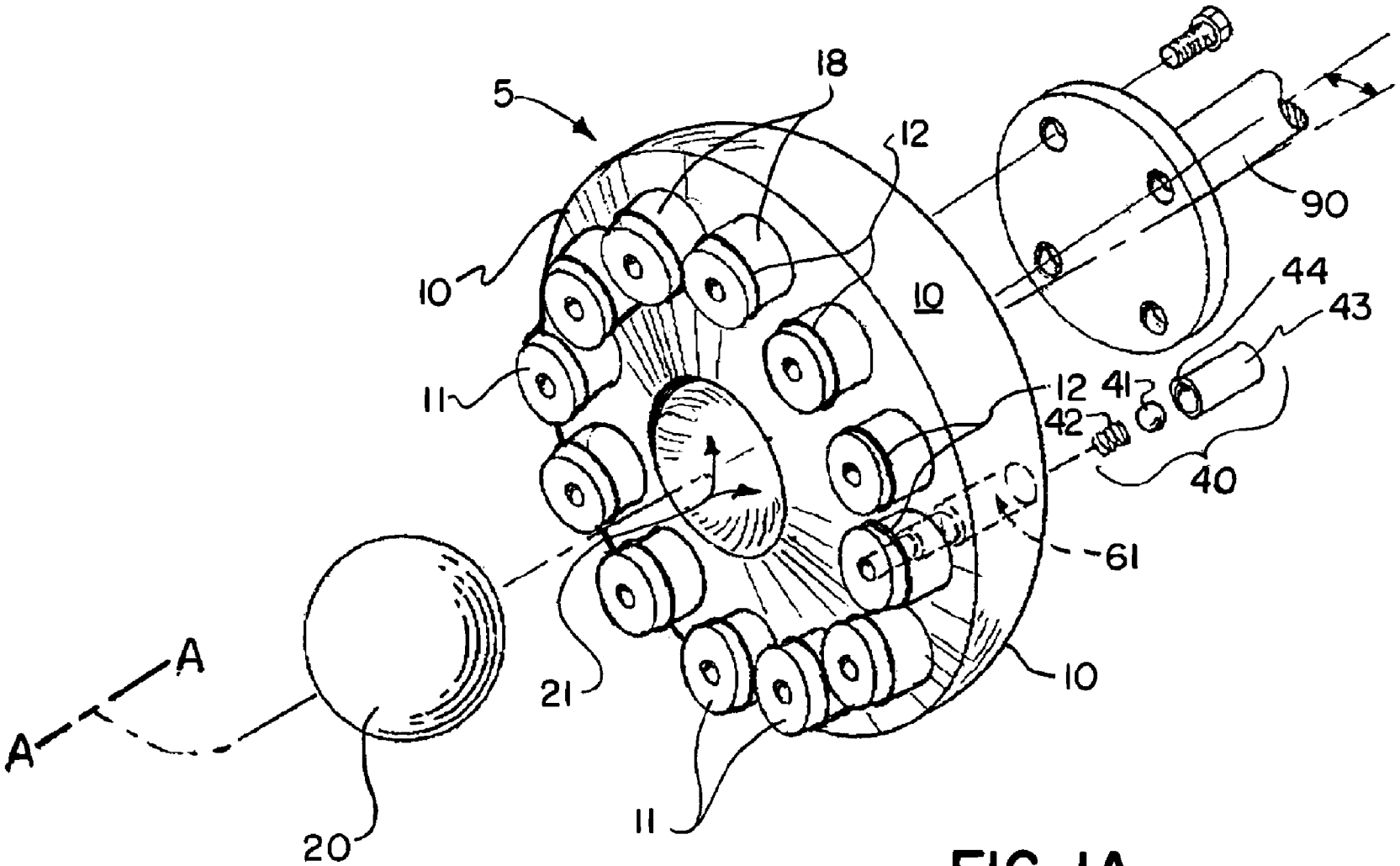
FIG. 1A-1B are exploded perspective views the preferred embodiment of the apparatus of the present invention and wherein the figures meet at match lines A-A.
Figure 1B:
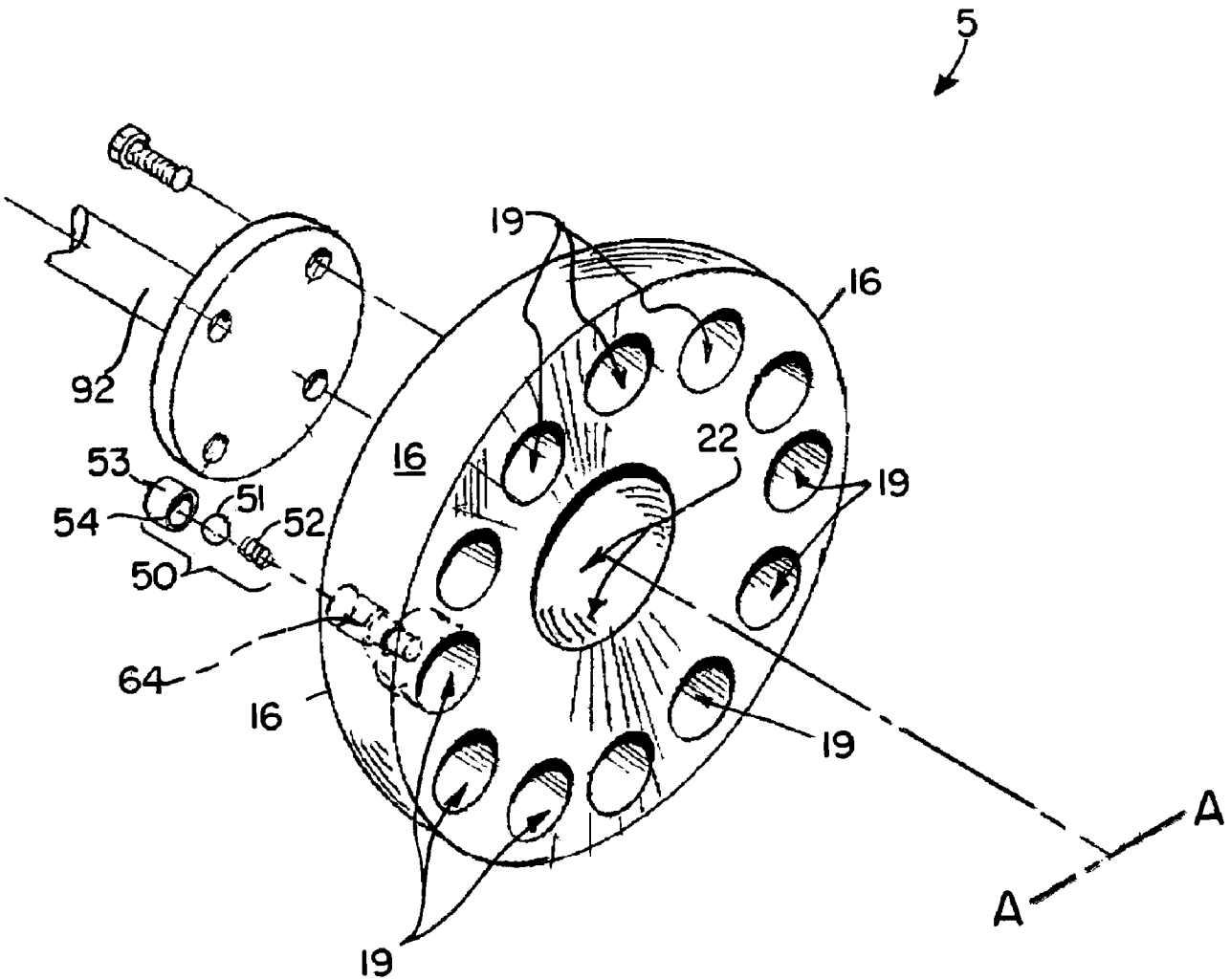

In FIGS. 1A, 1B and 2-6, the preferred embodiment of the apparatus of the present invention is designated generally by the numeral 5. Pump apparatus 5 includes an upper housing or rotor section 10 and a lower housing or rotor section 16. Each of the housing sections 10, 16 rotate together as a unit when one of the housing sections 10 or 16 is rotated such as with a powered or driven shaft (e.g., shaft 90). Rotation can be clockwise or counterclockwise.

The apparatus 5 includes a plurality of pistons 11. Each piston 11 carries a suction valve assembly 40 to seal the interface between projection 18 and socket 19 of each piston 11. Valve 40 orientation determines which side (i.e. section 10 or 16) is suction and which is discharge. Either section 10 or 16 can be a driver or be driven. The apparatus 5 can be used with or without spherical ball bearing 20, though use of bearing 20 is preferred.

A seal 12 on the outer surface of projection 18 part of piston 11 is provided. Seal 12 can be on the piston 11 or on the socket 19 of receiver 31. Socket 19 of piston 11 is provided on the second housing section 16 as shown in FIGS. 1A, 1B and 2-6.

Housing section 10 has inlet fluid chamber 61 that is receptive of fluid to be pumped or compressed. Housing section 16 has discharge passageway 64 through which fluid being pumped is discharged. The suction valve assembly 40 is positioned in inlet fluid chamber 61. A discharge valve assembly 50 is positioned in discharge passageway 64.

Figure 6:
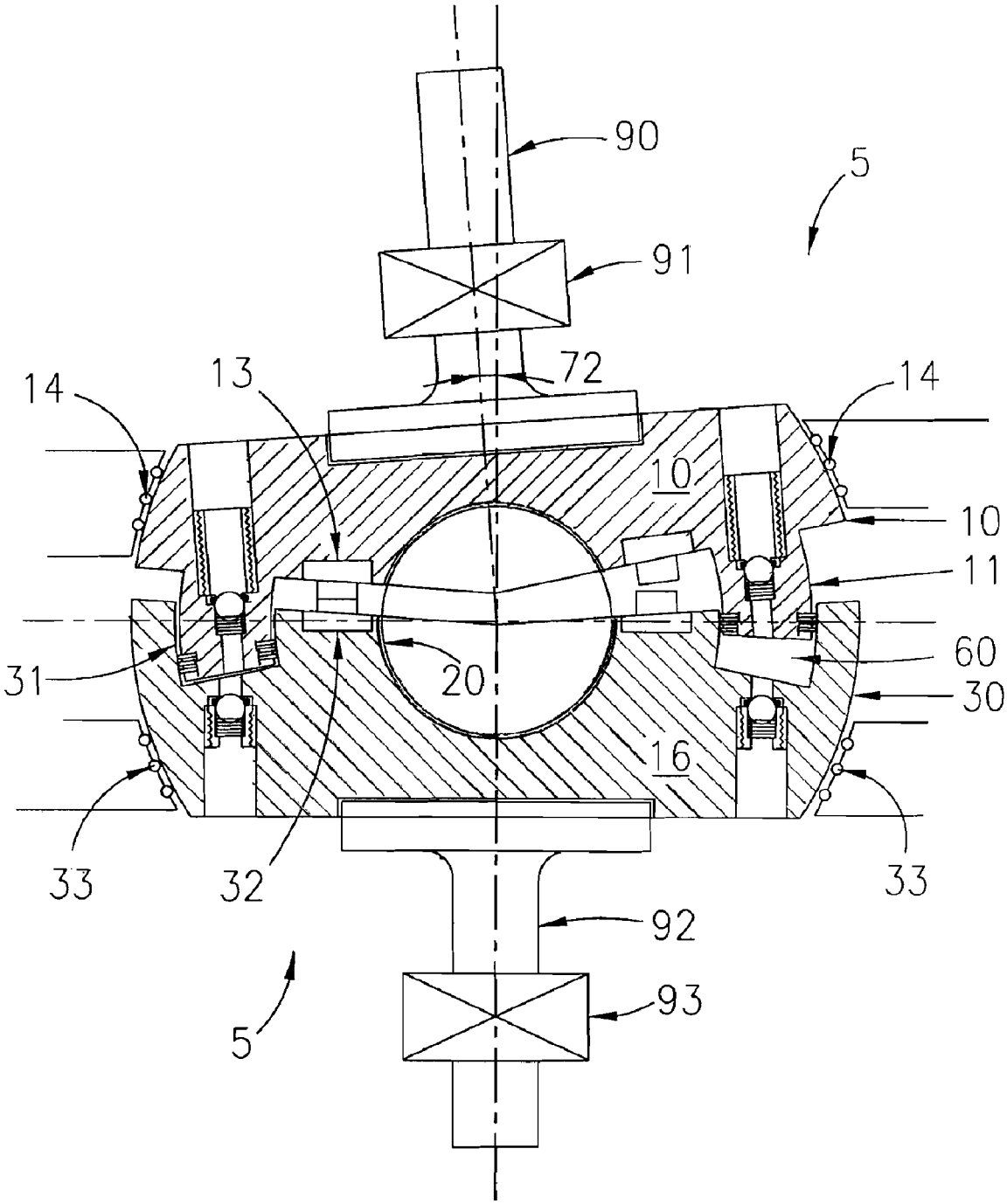
FIG. 6 is a side sectional elevation view of the preferred embodiment of the apparatus of the present invention.

Ball or spherical bearing 20 forms an interface bearing that contacts both of the housing sections 10, 16 at respective dished or concaved surfaces 21, 22. In FIG. 6, a gearing system 13 (e.g., toothed racks) can be optionally used to mechanically interface and transfer load between the housing sections 10, 16.

Figure 7:
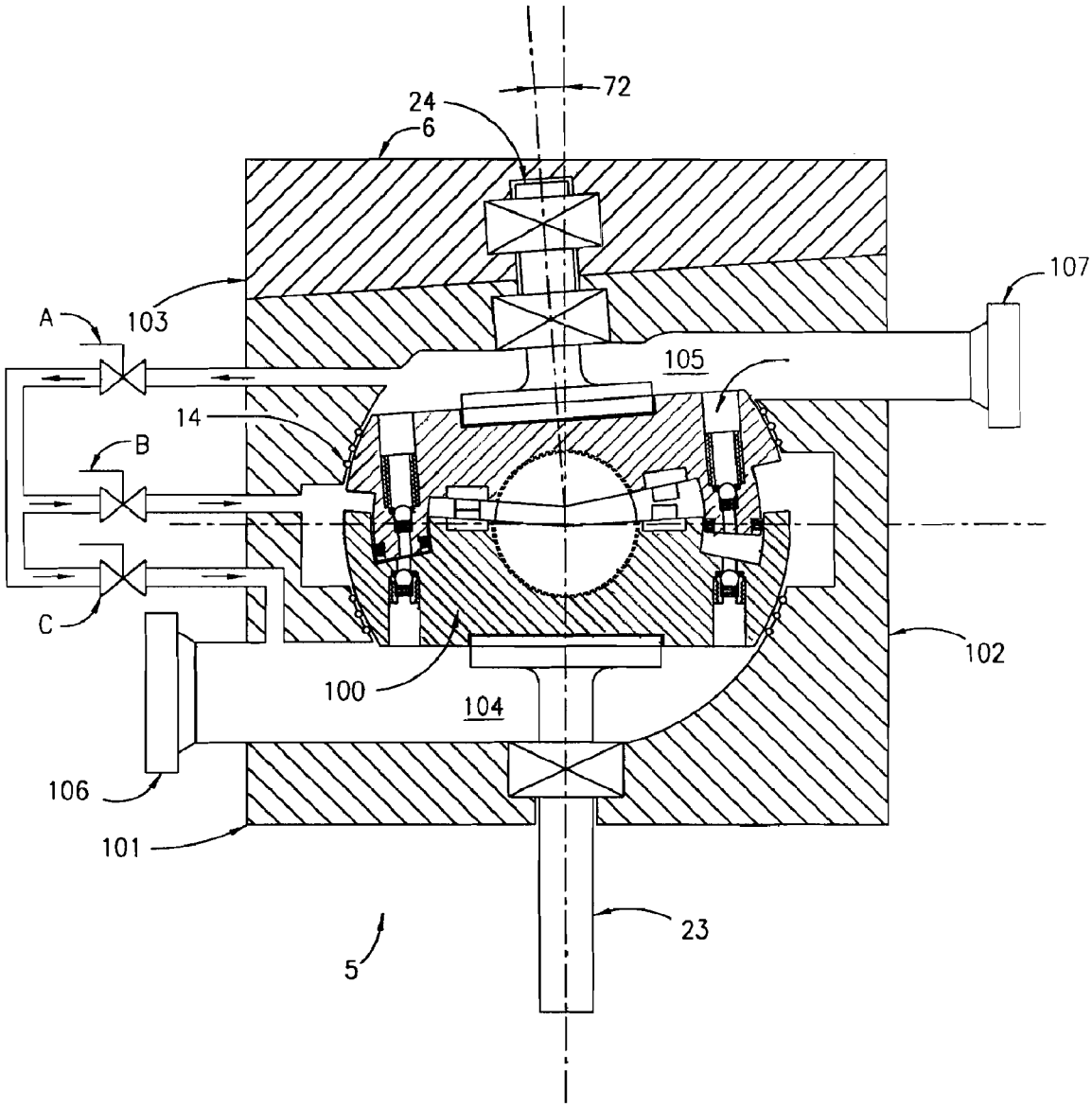
FIG. 7 is a side sectional view of the preferred embodiment of the apparatus of the present invention showing a single stage unit.
Figure 11:
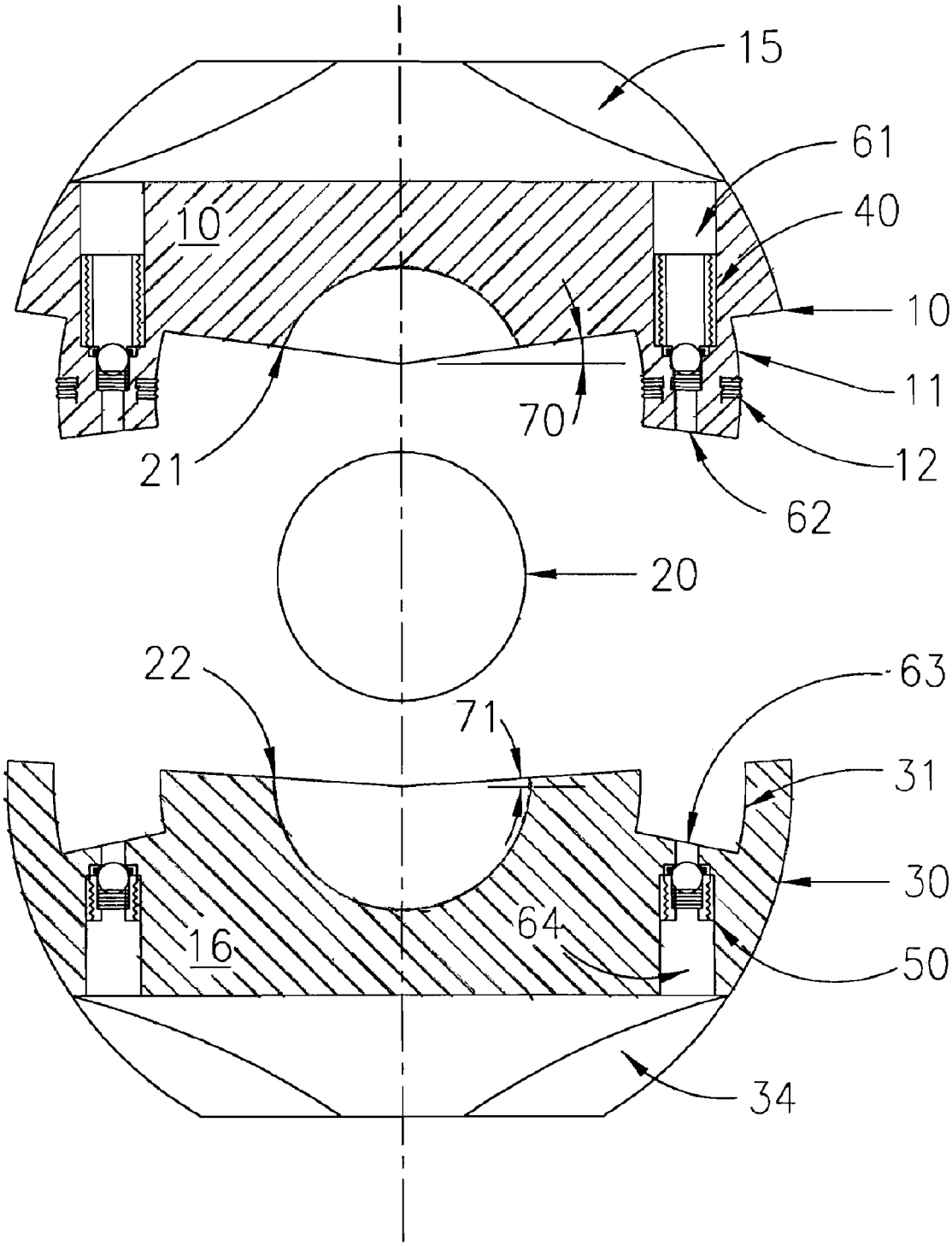
FIG. 11 is a side sectional exploded view of an alternate embodiment of the preferred embodiment of the apparatus of the present invention.

In FIG. 7, a single stage unit is disclosed wherein the upper and lower housing section 10, 16 are mounted within a block 6 that is defined by block sections 101, 102, 103, outer surfaces 30 engaged by sections 101, 102, 103. Seals 14 can be provided in between each housing section 10, 16 and block 6. In FIG. 11, a suction pressure booster 15 can be added to housing section 10. Torque enhancer 34 can be added to section 16.

In FIG. 11, part 15 is a pressure booster that can be finned either centrifugally or axially to boost the stream delivered to the suction valves. This booster 15 takes advantage of the fact that the rotor 10 is revolving in water and mechanically increases delivery to the compression chamber.

Part 34 has the opposite effect on the stream. It operates as a torque enhancer. As fluid leaves chamber 64, it will impinge on part 34 slightly reducing the stream pressure while giving the apparatus 5 added torque boost though fluid impact on part 34.

Figure 8:
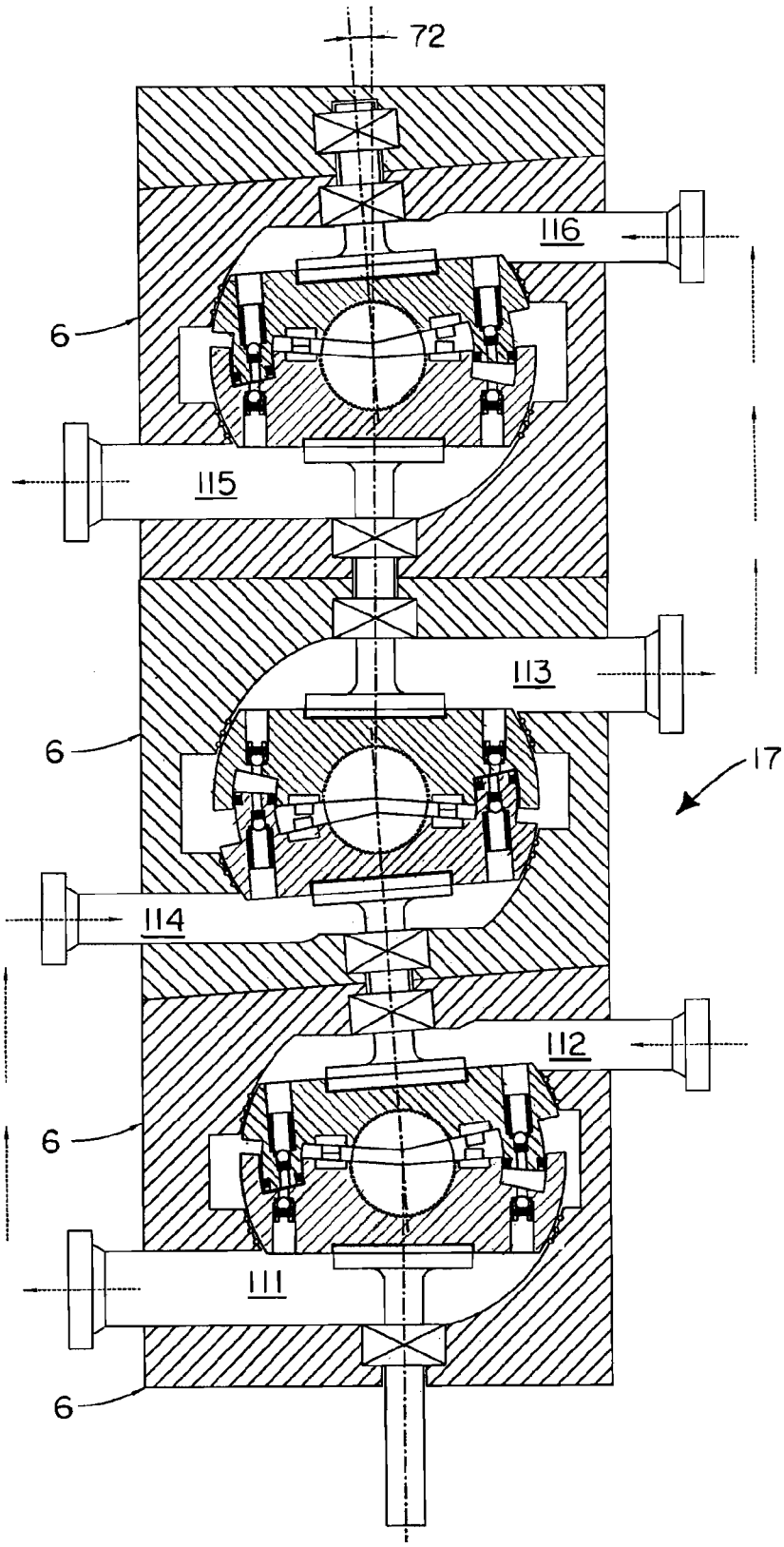
FIG. 8 is a side sectional view of the preferred embodiment of the apparatus of the present invention showing a multi-stage unit.

FIG. 8 shows a multi-stage unit 17 that can be comprised of a plurality of blocks 6 each having an apparatus 5. Each apparatus 5 has its own flow inlet and flow outlet as shown, designated generally by the numerals 111-116 in FIG. 8.

The obtuse angle that is formed between an axis of rotation for the sections 10, 16 is shown in FIG. 8 as 180° plus angle 72. The apparatus 17 of FIG. 8 thus shows a multi-stage apparatus that could have utility, for example, in the pumping of gas when the apparatus 17 is to be used as a compressor. Each socket 19 defines a receiver 31 into which projecting portion 18 extends.

An optional gearing system 13, 32 can help transfer load between the sections 10, 16 when they are rotated together using shafts 23, 24.

Two meshing gears 13, 32 can be mounted on the housing sections 10 and 16 respectively. The clearances between the gear teeth is less than the clearance between piston 11 and receiver 13. Therefore, the transfer of torque from part 10 to part 16 (i.e. driver to driven) is carried by the gears 13, 32 and not the seal rings 12. If there is no gear 13, 32 provided, part 10 transfers torque to part 16 and vice versa using seal 12 pushing on socket 19.

Figure 4A:
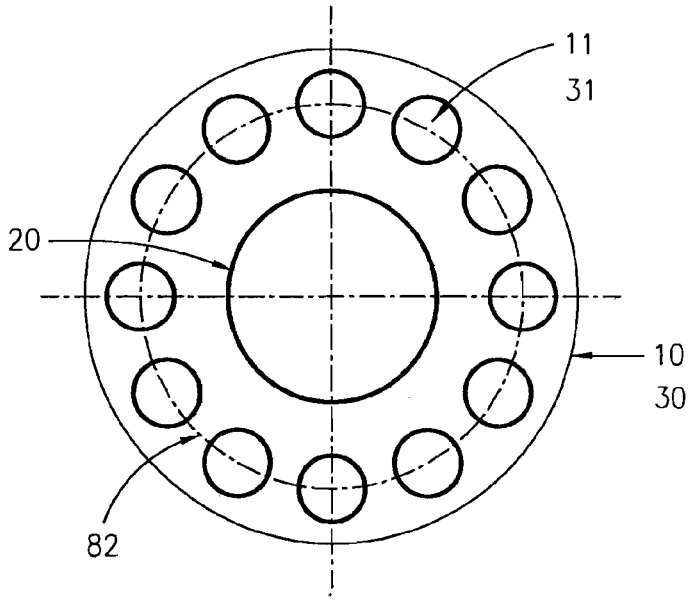
FIGS. 4A and 4B are schematic plan views showing one of the housing sections, with a single circle of pistons in FIG. 3A and a double circle of pistons in 3B.

FIG. 4A is a schematic plan view showing one of the housing sections, with a single circle of pistons 11 in FIG. 4A and a double circle of pistons 11 in 4B;

Each rotor section or housing section 10, 16 can have angle cuts 70 along the face, a dished cut out or concave surface 21 mating face for the spherical ball bearing 20. Conversely, depicted is the receiver rotor 16 including receivers 31, outlet chamber ports 63, discharge valve assemblies 50 depicted but not limited to ball/spring type and rotor outlet discharge passageway 64.

Figure 3A:
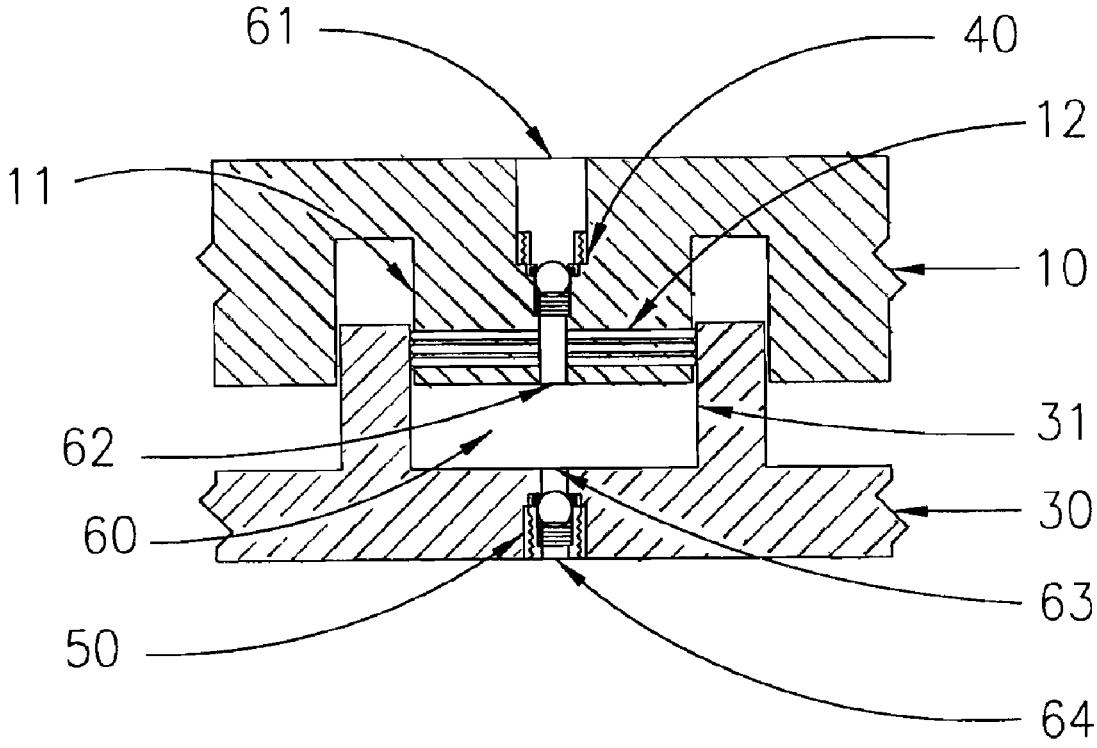
FIGS. 3A-3B are fragmentary sectional views of the preferred embodiment of the apparatus of the present invention showing maximum opening in FIG. 2A and minimum opening if 3B.
Figure 3B:
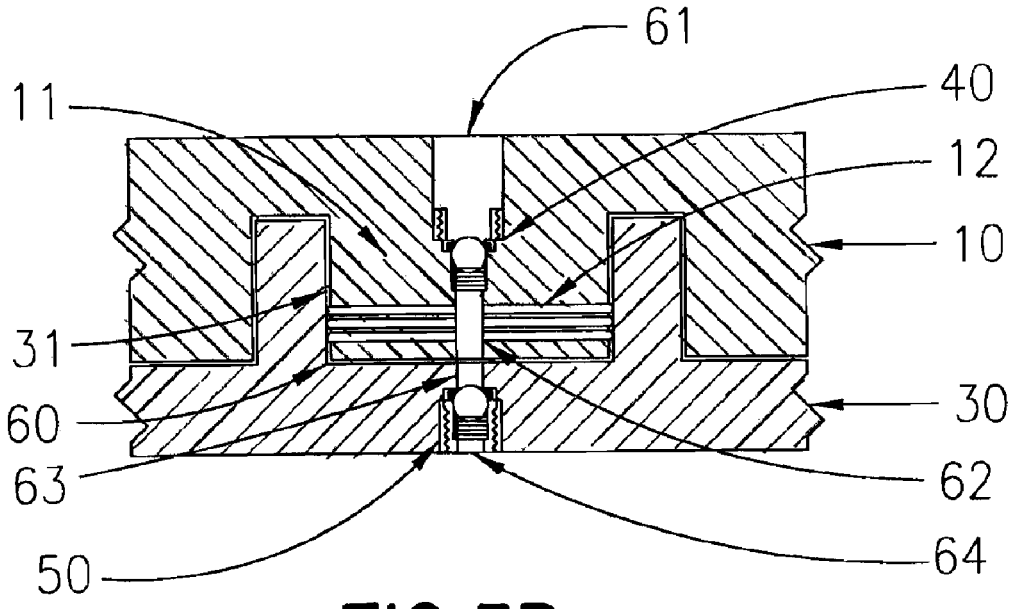

Fluid enters suction port 61 either boosted by part 15 or not, at a pressure assuming FIG. 3B minimum position as the piston 11 pulls away from the receiver 30 a lower pressure is experienced in chamber 60. The pressure differential between the suction passage 61 and compression chamber 60 opens valve 40 to allow fluid flow into chamber 60. During this operation, discharge valve 50 remains closed due to higher discharge line pressure in discharge chamber 64 compared to compression chamber 60. At FIG. 4A, maximum position, both valves 40, 50 are closed. During the compression stroke going from position 3A (maximum) to position 3B (minimum) pressure builds up in chamber 60. This higher pressure closes valve 40 as the pressure in the chamber 60 is higher than the suction line pressure 61.

When the pressure in chamber 60 becomes greater than the discharge pressure in port 64 plus the valve seating pressure, the discharge valve 50 opens and releases chamber 60 pressure into port 64 and into the discharge line. The drawings show a ball/spring combination which valve seating pressure is a function of ball area in contact with the stream and a spring constant.

An alternative valve design is shown in FIGS. 12-17, designated as valve 45. Valve 45 replaces the spring 42 or 52 with a shim disk 47 for which the spring constant is replaced by the beam flex of the shim disk 47. This shim disk 46 shows a smaller profile radially to the rotor 10 and 16 rotation reducing the centrifugal force effects on the mechanical operation of the valve allowing for higher speed operation. Valve 40 can be comprised of a ball 41, spring 42 and sleeve 43 having valve seat 44. Similarly, valve 50 can be comprised of ball 51, spring 52 and sleeve 53 having seat 54. For the alternate valve 45, a housing (e.g. steel) 46 has multiple radially and peripherally placed flow openings 48 covered with shim 47 (e.g. rubber or polymeric or metal). A central fastener 49 holds shim 47 to body 46. Flow through body 46 and its openings 48 causes shim 47 to bend and enable valve 45 to open.

Figure 16:
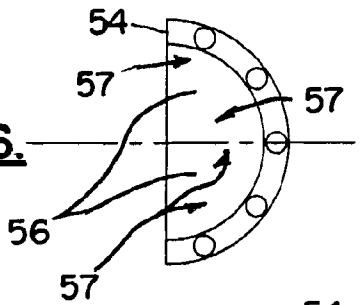
FIG. 16 is a top view of another, alternate pressure booster design that shows a suction inlet scoop design (the scoop acts as a pressure booster)
Figure 17:
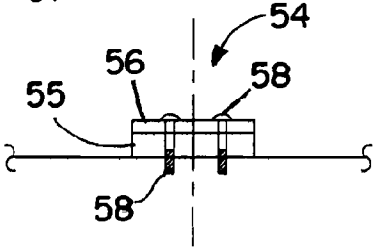
FIG. 17 is a side view thereof.
Figure 15:
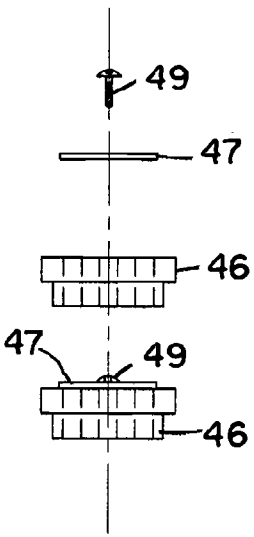
FIG. 15 is a side exploded view thereof for a receiver valve.
Figure 14:
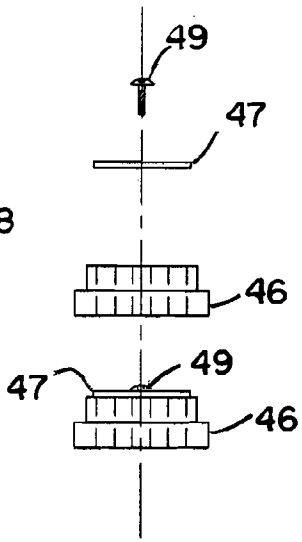
FIG. 14 is a side exploded view thereof for a piston valve.
Figure 12:
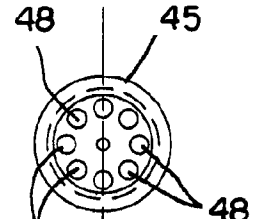
FIG. 12 is a top view of an alternate valve construction for use with the present invention.
Figure 13:
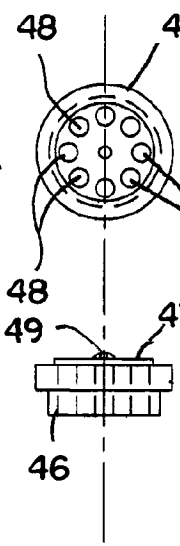
FIG. 13 is a side view of an alternate valve construction for use with the present invention.

Another pressure booster 54 is seen in FIGS. 16-17 that uses housing 55 that is U-shaped. A shim 56 (e.g. metal) covers flow opening 57. Fasteners 58 secure shim 56 to housing 55. Flow through housing 55 and its opening 57 causes shim 56 to bend and enables pressure booster 54 to open.

The face of the housing section 10 is cut at an angle 71 and includes dished cut out or concave surface 22 mating face for acceptance of orbiting ball or sphere 20. The ball 20 is not limited to being a separate item but also may be an integral part of either the piston rotor 10 or the receiver rotor 16, 30.

FIG. 3A is a diagram of maximum opening of a piston 11, and maximum volume, minimum pressure of the compression chambers 60 at the zero degree of rotation point between the piston rotor 10 and the receiver rotor 16 in relation to valve inlet 62 of piton 11 and outlet 64. FIG. 3B is a diagram that shows minimum opening and minimum volume, maximum pressure of the compression chambers 60 at the 180 degree of rotation point between the piston rotor 10 and the receiver rotor 16 in relation to valve inlet 62 and outlet 64.

FIG. 4A illustrates an exemplary layout of piston/receiver pairs 11/31 on the piston rotor 10 and receiver rotor 30 mating circle 82 while centering on the orbiting rider ball 20.

Figure 4B:
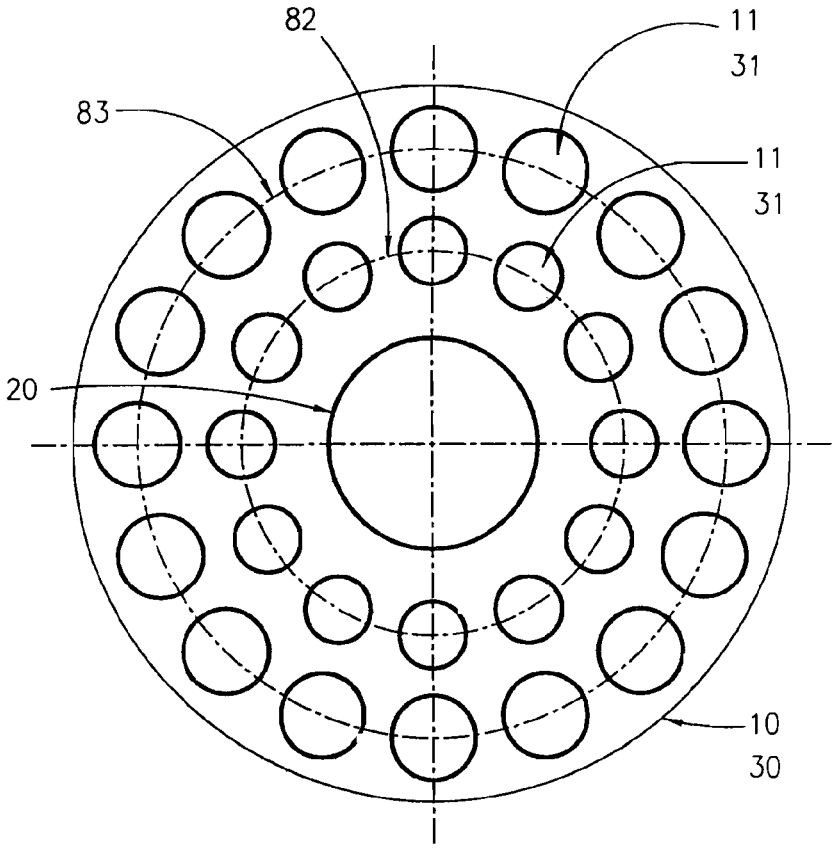

FIG. 4B illustrates an exemplary layout of piston/receiver pairs 11/31 on the piston rotor 10 and receiver rotor 30 dual mating circles 82/83 while centering on the orbiting rider ball 20.

Figure 2:
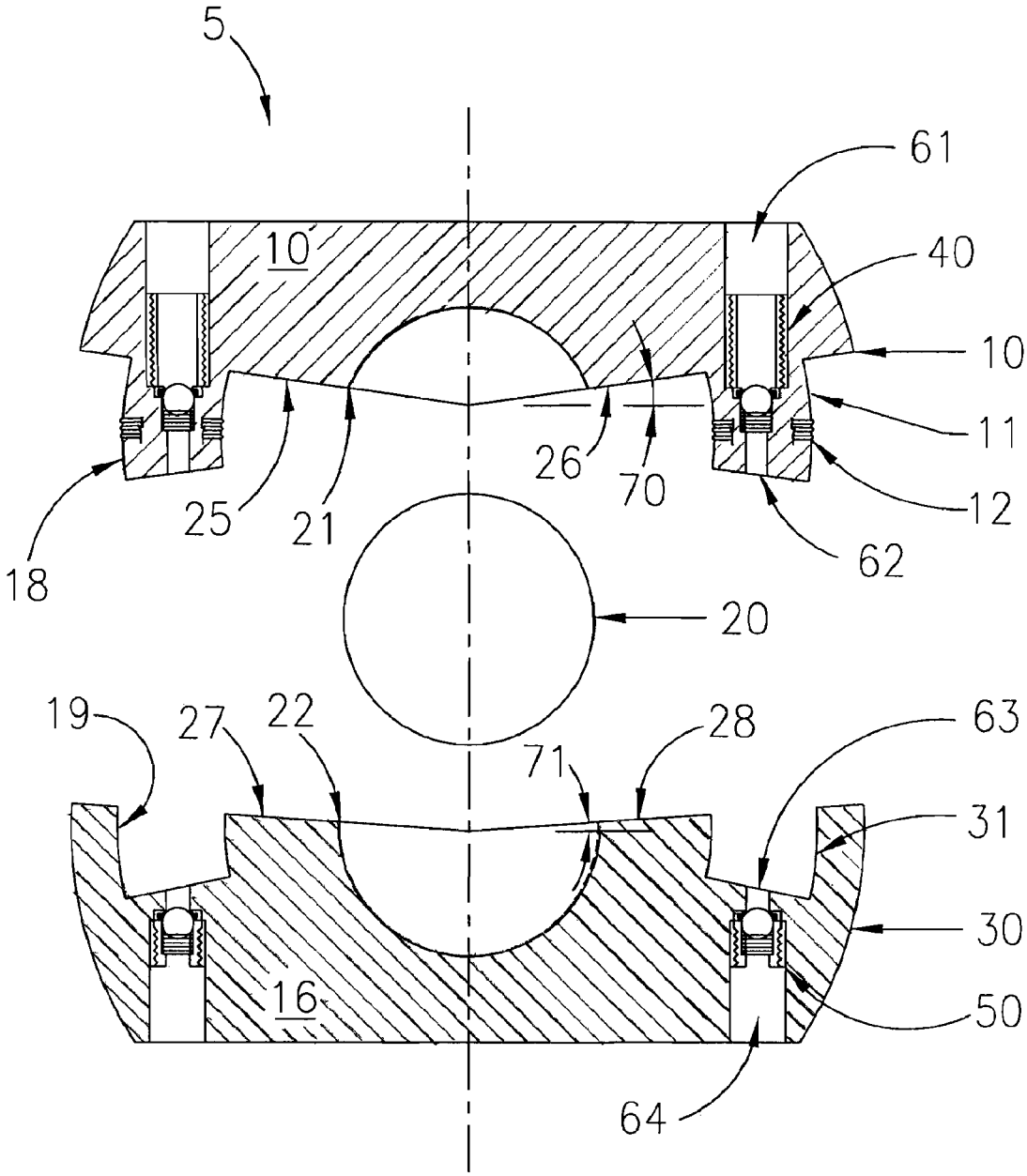
FIG. 2 is a exploded side, sectional view of the preferred embodiment of the apparatus of the present invention.
Figure 5:
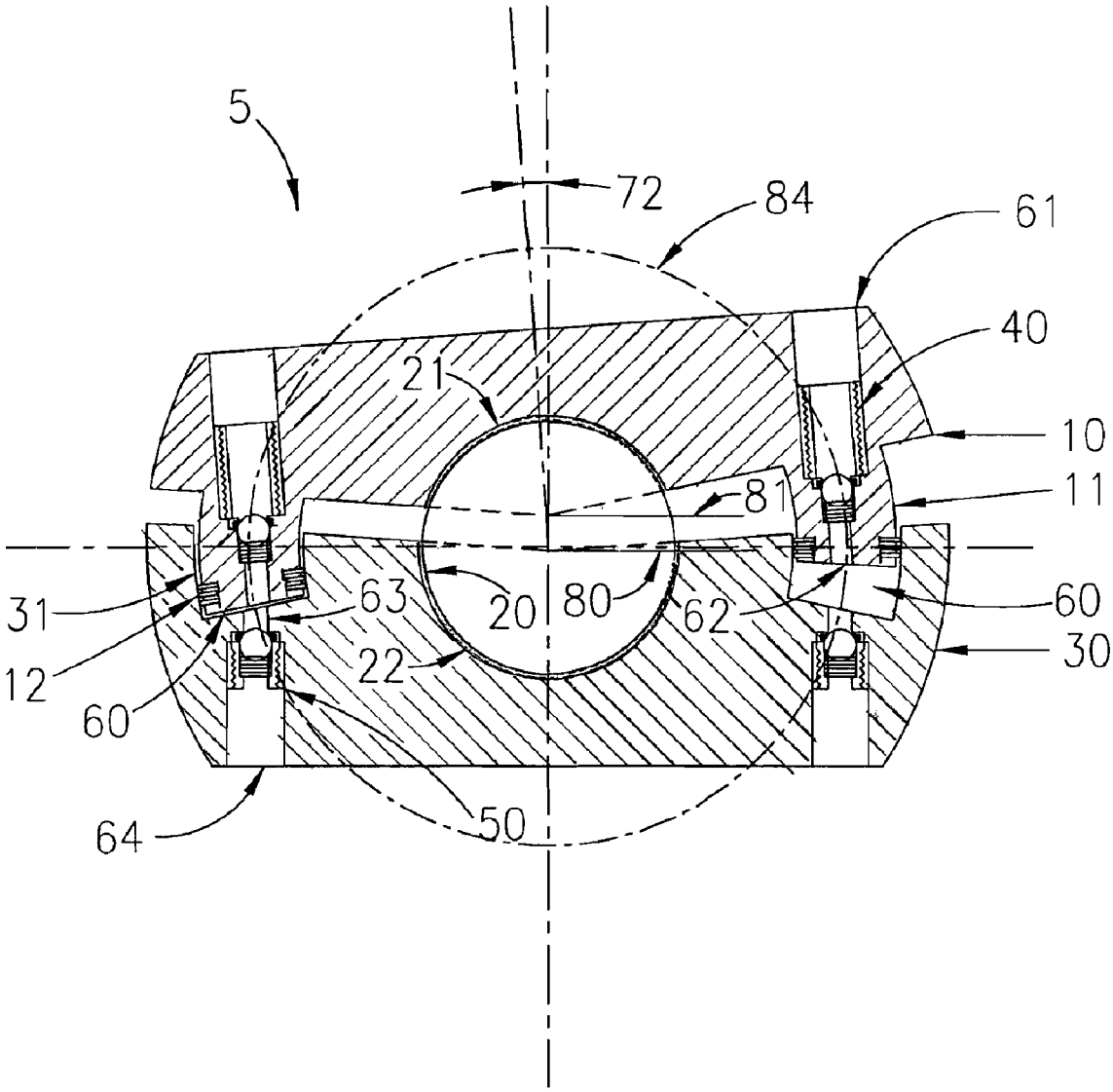
FIG. 5 is a side sectional view of the preferred embodiment of the apparatus of the present invention.

FIG. 5 illustrates the engagement geometry of the piston rotor 10, the receiver rotor 30 on the orbiting rider ball 20 with integral porting and valving described in FIG. 2. Linear offsets from the center of rotation (center of orbiting rider ball 20) 80/81 are depicted along with the piston rotor 10 rotation angular offset 72. Also, circumferential piston/receiver circular path 84 is shown.

FIG. 6 illustrates machine 5 including all aspects of subsequent figures combined with rotational shafts (clockwise or counter clockwise) 90/92 and a system of bearings to contain the rotation both in radial and axial directions. These bearings can be preferably installed to a fixed case or housing. Also depicted are a system of seals 14/33 to separate suction and discharge and provide an internal chamber that can be liquid filled for lubricating (if necessary) or cooling (predicted). In addition, a torque transmitting gearing system 13/32 is provided to allow driving through the machine 5 without relying on the piston/receiver 11/31 and seal 12 surfaces to provide that function. In certain designs the engaging piston/receiver/seal 11/31/12 surfaces may be able to transfer the torque. Therefore, the apparatus of the present invention does not exclude piston/receiver/seal 11/31/12 as an option for torque transmission.

FIG. 7 is an illustrative example of a single stage unit 6 incorporating the machine 5 in a fixed split housing 101/102 providing a fluid inlet connection 107, a suction collection chamber 105 open to all piston rotor inlet chambers 61. A fluid outlet discharge chamber 104 is provided, open to all receiver discharge ports 64 along with a housing outlet connection 106. Additionally, an end cap 103 is depicted to provide and additional bearing to confine the driven rotor that may or may not be necessary in all configurations.

FIG. 8 is an illustrative example of a multi-stage unit 17 which in effect is an alignment of single stage units 6 provided with an end cap. Although the multi-stage unit is shown as a having an external transfer of fluid for cooling and side streaming, all stages may be incorporated in a single housing. Fluid would pass from stage to stage internally and connection inter-stage for cooling and side streaming would be provided as an integral part of the single case.

Figure 9:
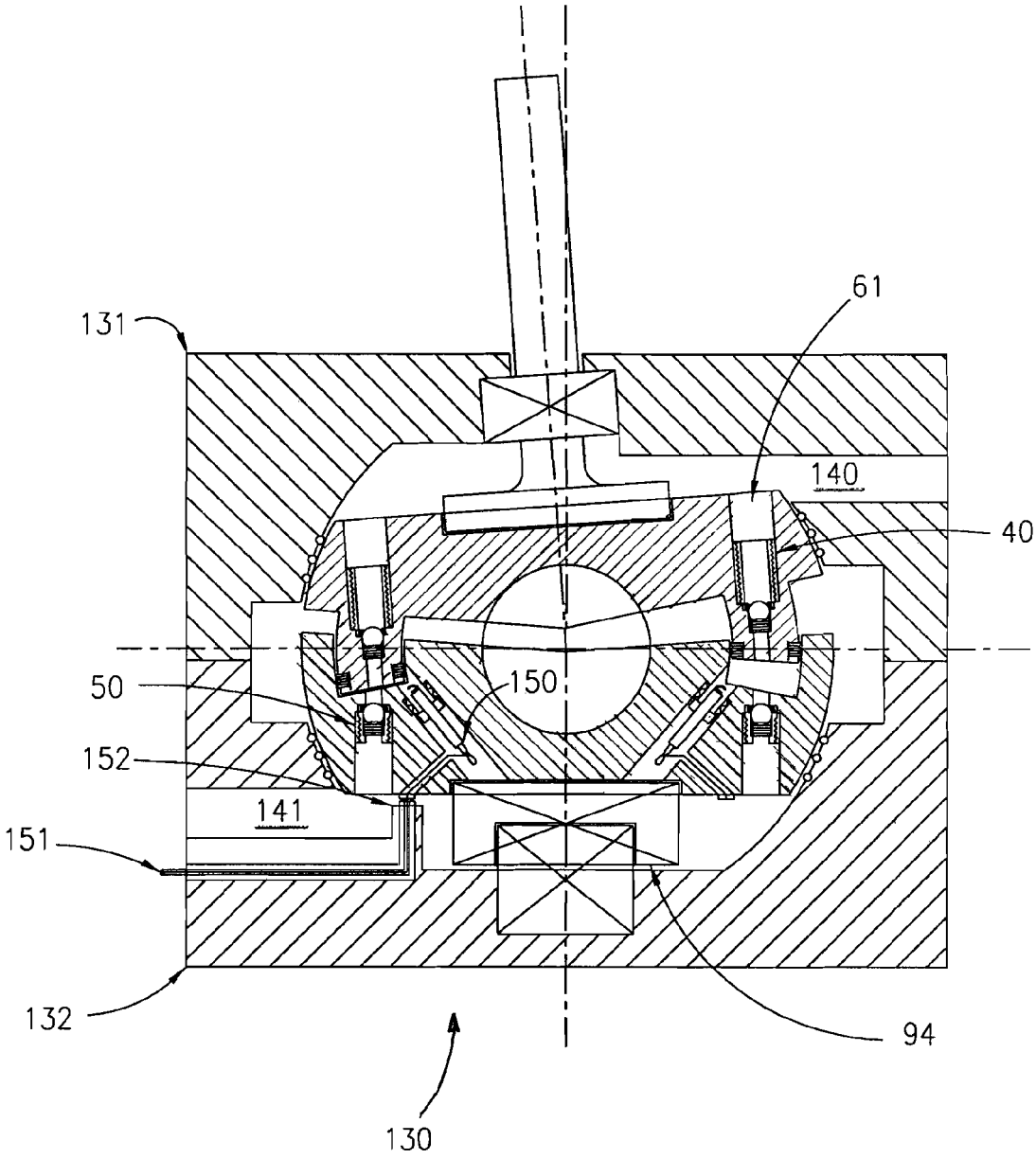
FIG. 9 is a side sectional view of the preferred embodiment of the apparatus of the present invention illustrating a free rotor engine.

FIG. 9 is an illustrative example of a free rotor engine 130 is depicted incorporating the machine 5 and allowing the receiver rotor to rotate on a case mounted bearing assembly 94 mounted as part of the split housing 132. Fuel would be introduced to the inlet chamber 140 and open to each of the piston rotor 10 inlet suction passageways 61. Around the 180-degree rotation position a sparking device 150, connected to each combustion chamber 60, would institute a spark in a combustion chamber. The release of combustion by-products would be via each piston/receiver pair 11/31 discharge valve assembly 50 through the outlet (exhaust) port 141. The housing depicted is not the limit of this document for the housing of the machine 5.

Figure 10:
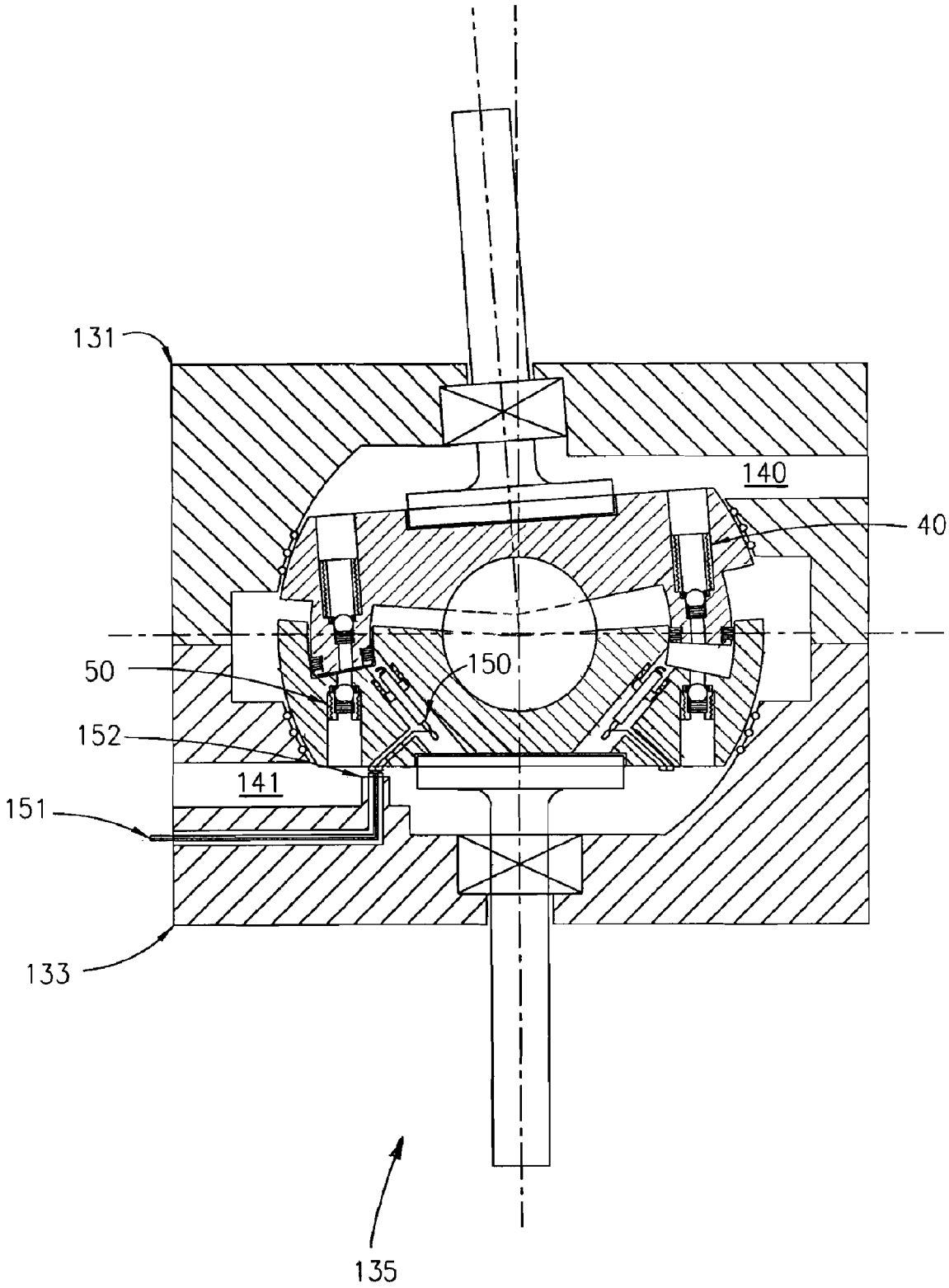
FIG. 10 is a side sectional view of the preferred embodiment of the apparatus of the present invention showing a dual rotor engine.

FIG. 10 is an illustrative example of a dual shaft rotating engine 135 that incorporates the machine 5 modified to include a sparking device for each receiver chamber 60. As rotating will not provide the ability for permanent connection of the sparking devices 150 a points type system 152 being wired through an access connection 151 is illustrated. The housing depicted is not the limit of this document for the housing of the machine 5.

FIG. 11 is an illustrative example of a suction pressure booster 15 and a discharge torque-enhancing device 34 added to the components described in FIG. 2. These two items 15/34 serve as examples for suction pressure increase and discharge torque accumulation but do not limit the machine 5 to just these two examples.

The machine 5 of the present invention are positive displacement devices used to compress fluids (gas or liquid) or work as an engine by engaging piston 11 and receiver 31 chambers 60 that exist on two opposing rotors 10 and 30. The compression occurs due to the inversion angle of the piston rotor 10 face in reference to the receiver rotor 30 face created by the engagement angle 72 or angular offset of the opposing shafts 90/92 (see FIG. 6). It is irrelevant which shaft 90/92 receives the displacement angle 72. Side to side tilting of the piston 11 and receiver 31 sealing surfaces in relation to each other is handled by coordinating two sets of dimensions. First the angle cuts 70/71 in the piston 10 and receiver 30 rotors, then by the offsets 80/81 (see FIG. 5) from the center of the orbiting riding ball 20. When the machine 5 is assembled, the two opposing rotors 10/30 are aligned on the riding ball 20 on opposing rotor cutouts 21/22 (FIGS. 2 and 5). Compression occurs on a circular path 84 (FIG. 5) radiated out from the center of rotation along the circumference of the circle 84. Each chamber 60 is isolated from the environment via the use of sealing rings 12 that seal the surfaces between the pistons 11 and receivers 31. The introduction of fluid (gas or liquid) is handled by a system of springs and balls that rotate with the rotor. For use as a pump or compressor 6, each piston/receiver 11/31 combination has an adjoining suction spring/ball assembly 40 located in the piston rotor 10. Conversely, for the release of fluid (gas or liquid) each piston/receiver pair 11/31 has an adjoining discharge spring/ball assembly 50 located in the receiver rotor 30. The piston/receiver pairs 11/30 are located along a circular path radiated out 82 or 83 (see FIG. 4B) as viewed from the center of the rotating shafts looking down the shaft toward the rotors 10/30. Each device may have either one 82 or multiple 83 compression circles on the same piston/receiver rotor pairs 10/30. For multi-stage operations 17, one device may be aligned to work in parallel or series service with adjoining devices of the same make-up.

Fluids (gas or liquid) are introduced to the single stage unit 6 (FIG. 7) through suction inlet 107 into the suction passage 105. The fluid then enters rotor suction chamber 61. Differential pressure in the compression chamber 60 and the rotor suction chamber 61 causes suction spring/ball assembly 40 to open allowing fluid into compression chamber 60 via suction rotor chamber inlet 62. As the rotors rotate they cause the volume in the compression chamber 60 to decrease, thereby increasing the pressure. When the pressure in the compression chamber reaches a point higher than that of the discharge passage 104, this differential pressure opens the spring/ball assembly 50 in the receiver rotor 30. Fluid will then flow through rotor the compression chamber outlet 63, over the spring/ball assembly 50 out of the rotor discharge passage 64. This compressed fluid collects in the case discharge chamber 104 and exits the machine 6 through the unit discharge outlet 106.

For multi-stage parallel or series service the flow path described above through the machine 5 from the suction rotor 10 inlet port 61 to the discharge rotor 30 outlet port 64 will remain consistent in each fluid compression path description to follow. For series stream compression, fluids (gas or liquid) are introduced to the multi-stage unit 17 through suction inlet 112 of the single stage unit 6 and through the machine 5 as described above. The fluid is collected in the case discharge chamber 111 and exits the single stage unit 6. This fluid may be taken off for inter-stage cooling and the stream may be increased or decreased by side stream gas ready for entry into the next single stage unit 6 to the second stage inlet chamber 114. The fluid is compressed though the second in-line machine 5 and passes through discharge outlet chamber 113 where again it may be cooled or effect a side stream as noted above. The fluid enters the next stage unit 6 through suction inlet chamber 116. The fluid is again compressed to a higher pressure through the machine 5 located in this single stage unit 6 and delivered to discharge passage 115 ready for delivery to another single stage compression unit 6 or for final delivery for service. For purely parallel service connection, two or more single stage units 6 may be connected in parallel with common suction pressure delivered to the inlet suction chambers 112/114/116. The fluid is compressed through each of the units and discharged through each single stage unit 6, discharge outlet chamber 111/113/115. For a mix of parallel and series service fluid may enter the first two single stage units 6 though the suction inlet chambers 112/114 and discharge through their discharge outlet chambers 111/113. This stream may be cooled or a side stream may be effected readying the fluid for deliver to the suction inlet chamber of the next single stage unit 6 at suction inlet port 116. The fluid is then compressed for final delivery exiting from the single stage unit 6 through discharge outlet chamber 115. These are but a few examples of how the multi-stage unit 17 may be setup. These examples are not meant to restrict the machine 5 to any of the fore mentioned examples. Any combinations of connection either internal or external are acceptable. Any size rotor pairs 10/30 is acceptable and shall be sized for the flow characteristics of each compression stream. Any combination of compression rings 82/83/84 is acceptable and covered by this document. Any shape and geometry of rotor pairs 10/30 and piston/receivers 11/31 are acceptable as long as they maintain the sealing of the compression chamber 60. Any configuration of inlet and outlet rotor passageways 61/62/63/64 and inlet and outlet valve assemblies 40/50 is acceptable.

This machine 5, being a positive displacement device, will inherently have the ability to institute flow control via speed control with low and high-speed applications included. In addition, setup flow control can be instituted via insertion or removal of suction spring/ball value assemblies 40/50 to activate or deactivate individual piston/receiver pairs 11/31, and is included. Any geometry for mounting the machine 5 into a case 6 and sizes of inlet and outlet chambers, passageways and connections are included.

For use as an engine 130 or 135, each rotor may rotate as dual drive 135 or single shaft drive 130. In the case dual drive 135, each piston cylinder pair 11/31 may have an adjoining suction (intake) 40 and discharge (exhaust) 50 spring/ball combination for the introduction of fuel and the release of combustion gases. In addition, each piston/receiver 11/31 pair will also have an adjoining device to spark the combustion 150 be it spark plug, element, etc., and a system to deliver the spark 151 transferred external to the rotors 10/30. In the case of single shaft drive 130 (case mounted bearing 94) this may be either the piston 10 or the receiver 30 rotor. The transfer of fuel to each chamber may be accomplished via a spring/ball combination 40 adjoined to each of the rotating piston/receiver 11/31 pairs. Each combustion chamber 60 will have an accompanying spring/ball assembly 50 in the case-rotating rotor to handle the release of combustion gases (exhaust) 141. Sparking of each combustion chamber may be handled by the sparking device 150 attached to each combustion chamber 60 and fed through the spark generating case port 151.

Torque requirements for use as an engine 130/135 may be effected and varied by the sequencing of spark delivered to the sparking device 150. For example, at low torque requirement periods a combustion-instituting spark may only be delivered to a set number of alternating piston/receiver 11/31 pairs. As the torque requirements increase more and more chambers 60 will be ignited. As stated above for the compression unit 6, the engine is not limited to the few configurations noted for engines 130/135, but includes all mounting, sizes and geometry required to use the machine 5 for engine, torque development applications. Variable aspects may include, but not be limited to, bearings 91/93/94, shafts 90/92, inlet and outlet valves 40/50, piston receiver pairs 11/31, rotor pairs 10/30, torque transfer gears 13/32, seals 12, sparking devices 150/151. They also include case designs 131/132/133 or any other factor that is required to place the machine 5 in service as an engine, pump or compressor.

Additions to the device may include the attachment of a turbine type device 15 to the piston rotor 10 to institute an increase in pressure delivered to the suction spring/ball 40 inlet ports 61. In a similar mounting arrangement, a torque converting or torque-enhancing device 34 may be mounted to the discharge or receiver rotor 30. In driving, or force transmission through the rotors 10/30 from shaft 90 to shaft 92, a gear system 13/32 may be incorporated as part of the rotors 10/30 to transfer the torque from shaft 90 to shaft 92 without transferring the force to the piston/receiver assemblies 11/30 nor to the seals 12 therein.

One of ordinary skill in this art will be able to determine appropriate materials for the various parts of the present invention.

All measurements disclosed herein are at standard temperature and pressure, at sea level on Earth, unless indicated otherwise. All materials used or intended to be used in a human being are biocompatible, unless indicated otherwise.

PARTS LIST

Parts No. Description
5 pump apparatus
6 block
10 upper housing section
11 piston
12 seal
13 gearing system
14 seal
15 suction pressure booster
16 lower housing section
17 multi-stage unit
18 projection
19 socket
20 spherical bearing
21 concave surface
22 concave surface
23 shaft
24 shaft
25 surface
26 surface
27 surface
28 surface
30 outer surface
31 receivers
32 gearing system
33 seal
34 discharge torque device
40 suction valve assembly
41 ball
42 spring
43 sleeve
44 seat
45 valve
46 housing
47 shim
48 opening
49 fastener
50 discharge valve assembly
51 ball
52 spring
53 sleeve
54 pressure booster
55 housing
56 shim
57 opening
58 fastener
60 compression chamber
61 inlet port
62 inlet
63 outlet chamber port
64 discharge passageway
70 angle
71 angle
72 angle
80 offset
81 offset
82 mating circle
84 mating circle
84 piston receiver circular path
101 block section
102 block section
103 block section
104 outlet chamber
105 suction chamber
106 housing outlet connection
107 fluid inlet connection
130 free rotor engine
132 split housing
135 dual shaft rotating engine

140 inlet chamber
141 exhaust port
150 sparking device
151 access connection
152 points type system The foregoing embodiments are presented by way of example only; the scope of the present invention is to be limited only by the following claims.

The invention claimed is:

1. A pump apparatus comprising:

a) a first housing section;

b) a second housing section;

c) a first shaft for rotating with the first housing section about a first axis;

d) a second shaft for rotating the second housing section about a second axis that forms an obtuse angle with the first axis;

e) a curved bearing member that forms an interface between the first and second housing sections, said curved bearing member being intersected by both axes and defining a center of rotation for both the first and the second housing sections;

f) a plurality of valved pistons positioned circumferentially around said curved bearing member, each piston having a first portion on the first housing section and a second portion on the second housing section, the pistons interconnecting the first and second housing sections so that when one housing section is rotated, the other housing section rotates with it;

g) a motor that rotates at least one of the shafts; and h) a fluid flow path that transmits fluid through the housing sections using the pistons, wherein each piston reciprocates to pump fluid under pressure as the housing sections rotate.

2. The pump apparatus of claim 1 wherein at least one of the housing sections has an inside surface that closely fits the outside surface of the curved bearing member.

3. The pump apparatus of claim 1 wherein both of the housing sections provide an inside surface that closely conforms to the outer surface of the curved bearing member.

4. The pump apparatus of claim 1 wherein the pistons each include interlocking portions of the first and second housing sections.

5. The pump apparatus of claim 4 wherein each piston includes a projecting part of one of the housing sections and a socket part of the other of the housing sections, the projecting and socket parts interlocking.

6. The pump apparatus of claim 1 wherein the pistons extend radially and circumferentially around the curved bearing member.

7. A pump apparatus comprising:

a) a first housing section having a concave surface portion;

b) a second housing section having a concave surface portion;

c) supports that support the housing sections so that they rotate about first and second respective axes that form an obtuse angle; and d) a motor drive that rotates the housing sections, wherein the housing sections are connected together so that they both rotate at a common revolution per minute;

e) a bearing member that interfaces the first and second housing sections, said bearing member being intersected by both axes and defining a center of rotation for both the first and the second housing sections;

f) a plurality of valved pistons positioned circumferentially around said bearing member, each piston having an upper position on the first housing section and a lower portion on the lower housing section, the pistons interconnecting the first and second housing sections so that when one housing section is rotated, the other housing section rotates with it; and g) a fluid flow path that transmits fluid through the housing sections using the pistons, wherein each piston reciprocates to pump fluid under pressure as the housing sections rotate.

8. The pump apparatus of claim 7 wherein the bearing member has an outside curved surface and at least one of the concave sections has an inside surface that closely fits the outside curved surface of the bearing member.

9. The pump apparatus of claim 7 wherein each housing section has an inside surface that closely conforms to the outer surface of the bearing member.

10. The pump apparatus of claim 7 wherein the pistons are equally spaced apart, positioned radially of and circumferentially around the bearing member.

11. The pump apparatus of claim 7 wherein the pistons each include interlocking portions of the first and second housing sections.

12. The pump apparatus of claim 11 wherein each piston includes a projecting part of one of the housing sections and a socket part of the other of the housing sections, the projecting and socket parts interlocking.

13. The pump apparatus of claim 7 wherein the pistons extend radially and circumferentially around the bearing member.

14. The pump apparatus of claim 7 wherein the supports include one or more drive shafts, each said drive shaft attached to a housing section.

15. A rotary piston apparatus comprising:

a) a first housing section having a plurality of circumiferentially spaced piston projecting sections;

b) a second machine housing section having a plurality of circumiferentially spaced piston socket sections;

c) each of said projection and socket sections defining a piston, said pistons positioned circumferentially on the housing sections;

d) a support for holding the housing sections in positions that enable them to interface so that the projection and socket sections expand and compress relative to one another as the housing sections rotate, wherein the upper and lower housing sections are rotatable relative to one another upon axes of rotation that form an obtuse angle;

e) a fluid inlet passageway on the first housing section; and f) a fluid discharge passageway on the second housing section, wherein each piston has a valve that controls fluid flow through the piston, and the periphery of one housing section approaches and then spaces away from the periphery of the other housing section and along a circumferential path so that each piston compresses and then expands as the housing sections rotate.

16. The rotating piston apparatus of claim 15 wherein the apparatus is a pump.

17. The rotating piston apparatus of claim 15 wherein the apparatus is an engine.

18. The rotating piston apparatus of claim 15 wherein the apparatus is a compressor.

* * * * *